US006719045B2

(12) United States Patent
Hart et al.

(10) Patent No.: US 6,719,045 B2
(45) Date of Patent: Apr. 13, 2004

(54) WHIPSTOCK ASSEMBLY

(75) Inventors: Shane Hart, Houston, TX (US); Mark Schnitker, Friendswood, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 10/226,917

(22) Filed: Aug. 23, 2002

(65) Prior Publication Data

US 2002/0195243 A1 Dec. 26, 2002

Related U.S. Application Data

(62) Division of application No. 09/545,917, filed on Apr. 10, 2000, now Pat. No. 6,464,002.

(51) Int. Cl.[7] ..... E21B 17/046

(52) U.S. Cl. ..... 166/117.6; 166/242.6; 175/81

(58) Field of Search ..... 166/117.6, 117.5, 166/242.6; 175/325.7, 325.2, 325.6, 81, 230

(56) References Cited

U.S. PATENT DOCUMENTS

| | | | | |
|---|---|---|---|---|
| 5,297,638 A | | 3/1994 | Dolence, Jr. | 175/61 |
| 5,425,417 A | | 6/1995 | Carter | 166/117.6 |
| 5,647,436 A | | 7/1997 | Braddick | 166/298 |
| 5,787,978 A | * | 8/1998 | Carter et al. | 166/117.6 |
| 5,826,651 A | | 10/1998 | Lee et al. | 166/117.6 |
| 5,894,889 A | | 4/1999 | Dewey et al. | 166/298 |
| 6,244,340 B1 | | 6/2001 | McGlothen et al. | 166/255.3 |
| 6,360,821 B1 | | 3/2002 | Braddick | 166/117.6 |
| 6,464,002 B1 | | 10/2002 | Hart et al. | 166/117.6 |

FOREIGN PATENT DOCUMENTS

| | | | |
|---|---|---|---|
| EP | 0 446 976 | 8/1991 | E21B/33/129 |
| EP | 1 030 030 | 1/2000 | E21B/23/02 |
| GB | 2246585 A | 5/1992 | E21B/23/00 |

OTHER PUBLICATIONS

PCT International Search Report, Dated Aug. 13, 2001.

* cited by examiner

*Primary Examiner*—Zakiya Walker
(74) *Attorney, Agent, or Firm*—Moser, Patterson & Sheridan, L.L.P.

(57) ABSTRACT

The apparatus is a whipstock assembly for use in a wellbore to form a lateral wellbore therefrom. In one aspect, a whipstock is attached to a cutting tool by a shearable connection whereby the whipstock and cutting tool assembly may be run into the wellbore simultaneously. The shearable connection is designed to fail in compression while being able to withstand forces in tension brought about by the whipstock, accessories and extensions required to properly place the whipstock above a preset packer in the wellbore. The shearable connection means consists of two sets of shearable members, one set provides equal shear resistance in tension and in compression, another set provides shear resistance in tension, but not in compression. The resulting connection is stronger in tension than in compression and failure of the connection due to the weight of the whipstock assembly is less likely.

6 Claims, 12 Drawing Sheets

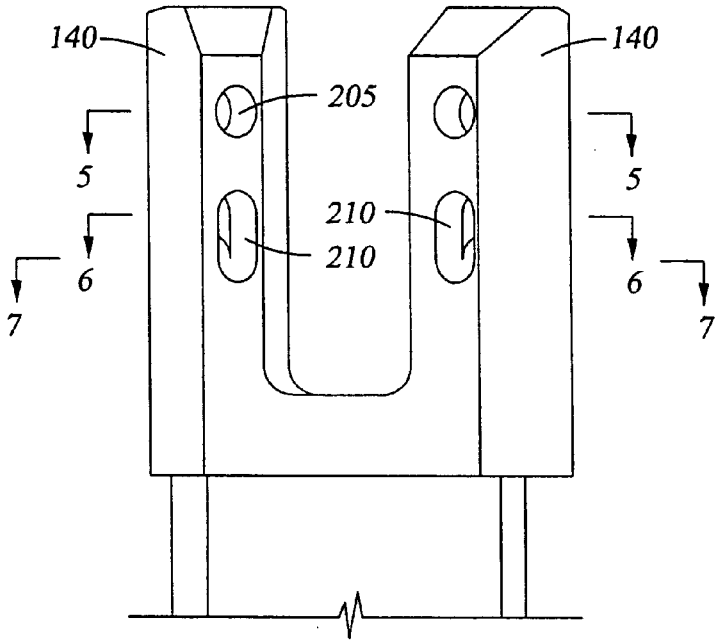
Fig. 3
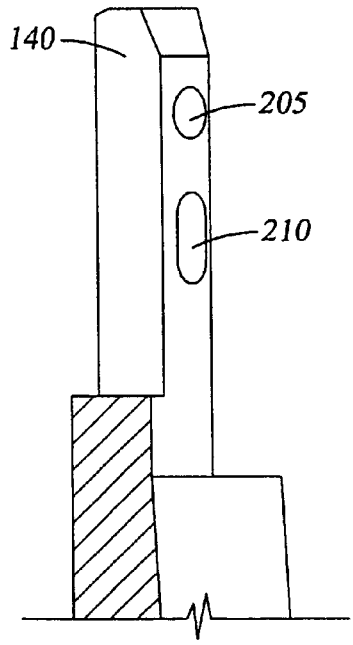
Fig. 4
Fig. 5
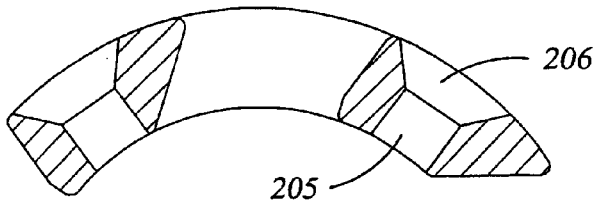
Fig. 6
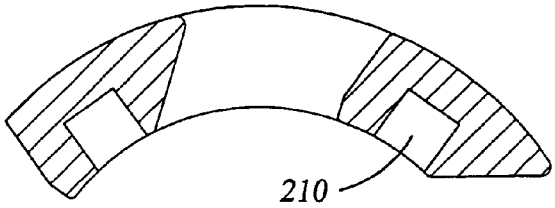
Fig. 7
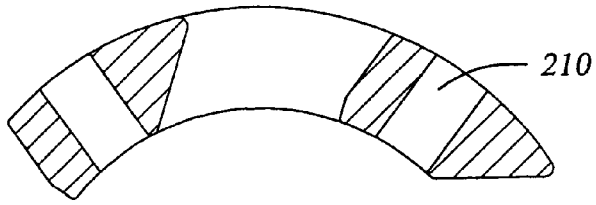

WHIPSTOCK ASSEMBLY

CROSS-REFERENCE TO RELATED APPLICATIONS

This application is a divisional of Ser. No. 09/545,917 filed on Apr. 10, 2000 is now U.S. Pat. No. 6,464,002, issued Oct. 15, 2002.

BACKGROUND OF THE INVENTION

1. Field of the Invention

The invention is related to a downhole milling and drilling assembly, more particularly to a whipstock assembly having a shearable connection with enhanced shear strength in one direction.

2. Background of the Related Art

In the drilling of oil and gas wells, lateral wellbores are often required to form another wellbore into an adjacent formation, to provide a perforated production zone at a desired level, to provide cement bonding between a small diameter casing and the adjacent formation, or to remove a loose joint of surface pipe. To create the lateral wellbore, milling tools are used for removing a section or a "window" of existing casing from a primary wellbore. The milling tools have cutting blades and typically utilize a diverter such as a whipstock to cause the tool to be moved laterally while it is being moved downwardly and rotating in the wellbore to cut an angled opening, pocket or window in the well casing or a borehole.

Formation of a lateral wellbore is typically performed in a step saving manner according to the following steps: An anchoring member or packer is set in a wellbore at a desired location below the location where the lateral wellbore will be formed. The packer acts as an anchor against which tools above it may be fixed in place in the wellbore. The packer typically has a key or other orientation indicating member and the packer's orientation is checked by running a tool such as a gyroscope indicator into the wellbore. A whipstock/cutter combination tool is then run into the wellbore and landed in the packer whereby the whipstock is oriented in the direction of the desired lateral wellbore. The cutter is connected to the whipstock by a shearable member, like a bolt. In this manner, the cutter and whipstock can be run-in to the well together, saving an additional trip. Pushing on the cutter shears the bolt, freeing the cutter from the tool. Rotation of the string and the cutter can then begin the formation of the lateral wellbore.

Multiple lateral wellbores in a well necessitate the setting of a whipstock at various vertical locations in the wellbore. Rather than removing and relocating the packer, extensions are used between the whipstock and the packer to accurately locate the whipstock at that point in the wellbore where the next lateral wellbore will be formed. Depending upon the distance between the packer and the new wellbore, an extension member can add significant weight to the combination tool. In some instances, the weight of the whipstock, stinger, extensions and accessories can exceed the shear strength of the connection member between the cutter and the whipstock, which is designed to shear only upon the placement of weight on the connection from above. For example, in a 5½" wellbore, a whipstock and stinger typically weighs around 1,000 lbs. and the shear value of the shearable connection between the whipstock and cutter is about 16,000 lbs. An extension and accessories, like a stabilizer, could add 16,000 lbs. to the assembly bringing the weight near the shear value of the connection between the whipstock and cutter. In another example, a 9⅝" wellbore typically utilizes a whipstock and stinger having a combined weight of 3,000 lbs. The shear value of the connection between the whipstock and cutter in these wells is around 30,000 lbs. Extensions and accessories for a lateral wellbore can weigh as much as 30,000 lbs., bringing the total weight of the assembly over the shear value of the connection. A failure of the shearable connection from tensile force placed upon it from below could result in a loss of the whipstock assembly and/or the packer therebelow and damage to the well. Simply increasing the shear strength of the connection member is not a viable option, since compressive force from above to shear the strengthened connection may not be available, and damage to parts of the assembly may result from the increased force.

In addition to the need for enhanced tensile resistance to the shearable connection between the whipstock cutter, there are instances when increased compressive shear strength is needed to prevent a failure of the connection when the assembly is being pushed into a horizontal wellbore against its own weight and friction with the wellbore casing.

There is a need therefore for a whipstock assembly with a shearable connection between the cutter and whipstock that can withstand tensile forces applied by the weight of the whipstock assembly. There is also a need therefore for a shearable connection between a whipstock and a cutter which will tolerate greater forces in one direction than in an opposite direction but still fail upon the application of a compressive force from above. There is a further need therefore, for a shearable connection member which has greater strength in tension than in compression.

SUMMARY OF THE INVENTION

The present invention discloses a whipstock assembly for use in a wellbore to form a lateral wellbore therefrom. In one aspect, a whipstock is attached to a cutting tool by a shearable connection whereby the whipstock and cutting tool assembly may be run into the wellbore simultaneously. Upon compressive force from above, the shearable connection fails and the cutting action can begin. The shearable connection is designed to fail in compression but to withstand forces in tension brought about by the whipstock, accessories and extensions required to properly place the whipstock above a preset packer in the wellbore. In one aspect, the shearable connection means provides a first set of shearable members with equal shear resistance to tensile and compressive forces applied between the whipstock and cutter. Another set of shearable members provide shear resistance against tensile forces between the whipstock and cutter but do not provide shear resistance against compressive forces. The resulting connection is stronger in tension than in compression and failure of the connection due to the weight of the whipstock assembly is less likely. In another aspect of the invention, a retractable finger provides additional shear strength in tension. The retractable finger is spring-loaded and is housed in a slot formed in a lug portion of the whipstock. When the shearable connection is in tension, the finger interferes with a surface formed in the cutter, adding additional shear strength to the connection. When the shearable connection is in compression, the finger folds into the slot, providing no additional resistance against the compressive force. In another aspect of the invention the shearable connection is designed to provide additional shear resistance to compression forces but not to tensile forces applied between the whipstock and cutter.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 3 is a front view of the lug portion of the whipstock illustrating the circular and elongated apertures formed therein.

FIG. 4 is a side view, partially in section of the lug portion of FIG. 3.

FIGS. 5–7 are section views taken along lines 5–5, 6–6 and 7–7 of FIG. 3 and depicting the circular and elongated apertures in the lug portion.

DETAILED DESCRIPTION OF THE PREFERRED EMBODIMENT

Figure 1:
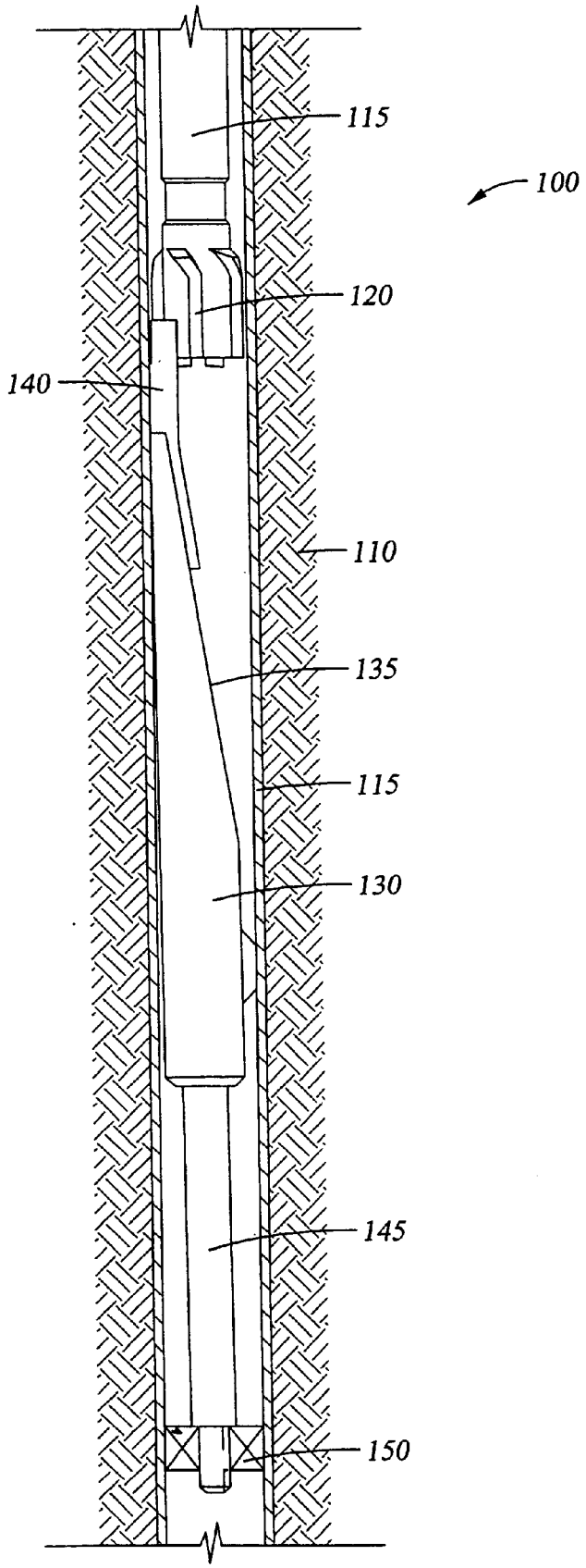
FIG. 1 is a schematic view showing one embodiment of the whipstock assembly of the present invention in a wellbore.

FIG. 1 is a schematic view of the whipstock assembly 100 of the present invention installed a wellbore 110. The wellbore is typically lined with pipe 115 but could be an unlined borehole. The whipstock assembly includes a cutter 120 or mill which is disposed on a run in string. The run-in string will ultimately be used to rotate and advance the cutter and form the lateral wellbore. In one example, the cutter is designed to form the entire lateral opening in the wellbore including the removal of the casing and the starting hole in the formation. A whipstock 130 include a concave, slanted portion 135 which cooperates with the cutter 120 to facilitate the formation of a window (not shown) in the wellbore 110. The whipstock 130 is connected at an upper end to the cutter thereabove by a shearable connection. In the preferred embodiment, the shearable connection is formed between the cutter and lug members 140 formed at the upper end of whipstock 130. Below the whipstock 130 is an extension 145 having a length to accurately place the whipstock 130 at that vertical location in the wellbore where a new lateral wellbore is to be formed. The extension member extends from the whipstock to a preset packer 150 in the wellbore therebelow. The extensions can vary in length, depending upon the desired placement of the new wellbore and by using extensions of different lengths, the same packer can be used for each new lateral wellbore.

In the preferred embodiment, the whipstock cutter, extension and accessories are assembled at the surface of the well and run into the well as one assembly in order to save multiple trips. The extension below the whipstock ensures that the whipstock is located at the desired vertical location in the wellbore. The whipstock is rotationally set in the wellbore by cooperation of a key at the downhole end of the extension with a slot in the preset packer. Thereafter, a compressive force from above, applied upon the cutter, will shear the shearable connection between the cutter and the whipstock, separating the two and permitting the milling operation and the formation of a new lateral wellbore to begin.

Figure 2:
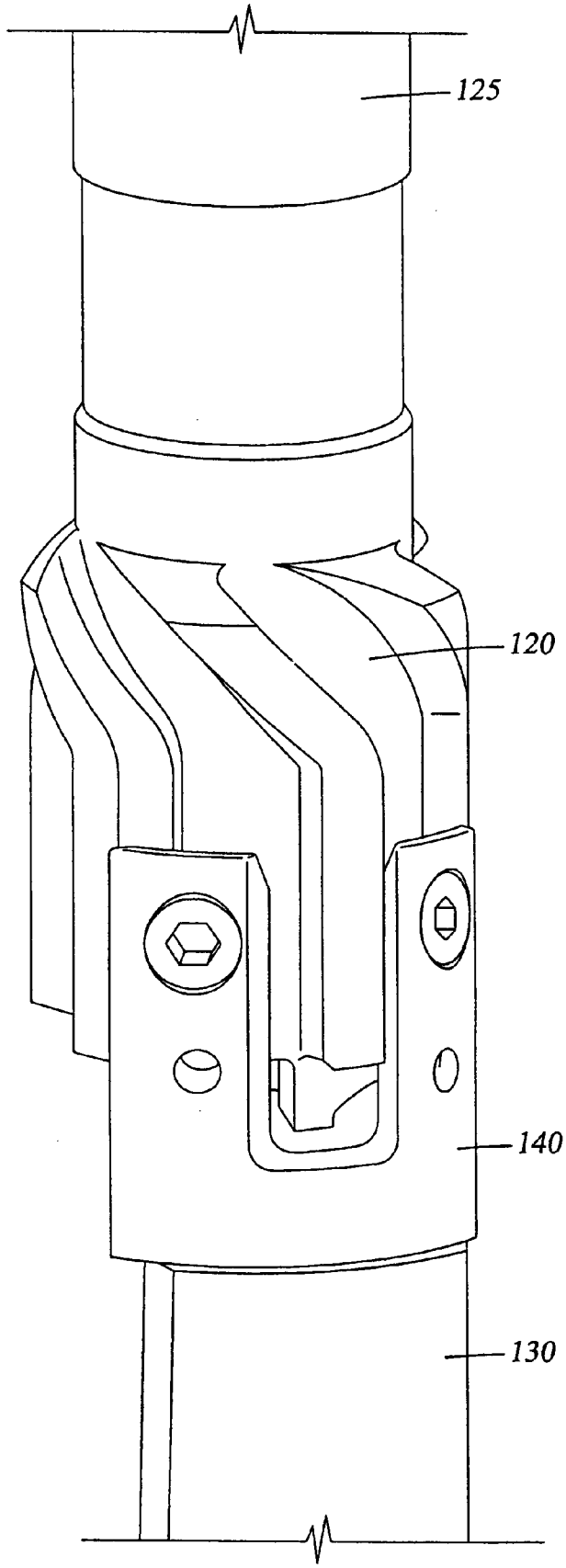
FIG. 2 is a perspective view showing the cutter and whipstock and the shearable connection therebetween.

FIG. 2 is a perspective view showing run-in string 125, cutter 120 and lugs 140 of whipstock 130. This shearable connection of the embodiment is made between the lug 140 and the cutter 120. However, the sharable connection could be between any adjacent portions of the cutter and whipstock. In the embodiment illustrated in FIG. 2, two shearable members provide resistance to both compressive and tensile forces applied between the whipstock and cutter and two shearable members provide resistance only to tensile forces between the whipstock and cutter. FIG. 3 is a view of the inside surface of the lugs 140 and FIG. 4 is a side view thereof. The lugs 140 include a plurality of apertures therethrough which are designed to align with apertures in the cutting member.

Each lug 140 includes a first circular aperture 205 extending therethrough and another elongated aperture 210 therebelow terminating at the inside surface of the lug 140 in an elongated shape. FIG. 5, taken along lines 5–5 of FIG. 3, depict the circular apertures 205 extending through the lug. As shown in the Figure, the apertures are countersunk at an outside edge 206 to house the head of a threaded member. FIG. 6 depicts the upper portion of elongated apertures 210 taken along lines 6–6 of FIG. 3. FIG. 7, taken along lines 7–7 of FIG. 3 depicts the lower portion of the elongated aperture 210 extending through the lug and terminating in an elongated shape at the inside surface thereof.

Figure 8:
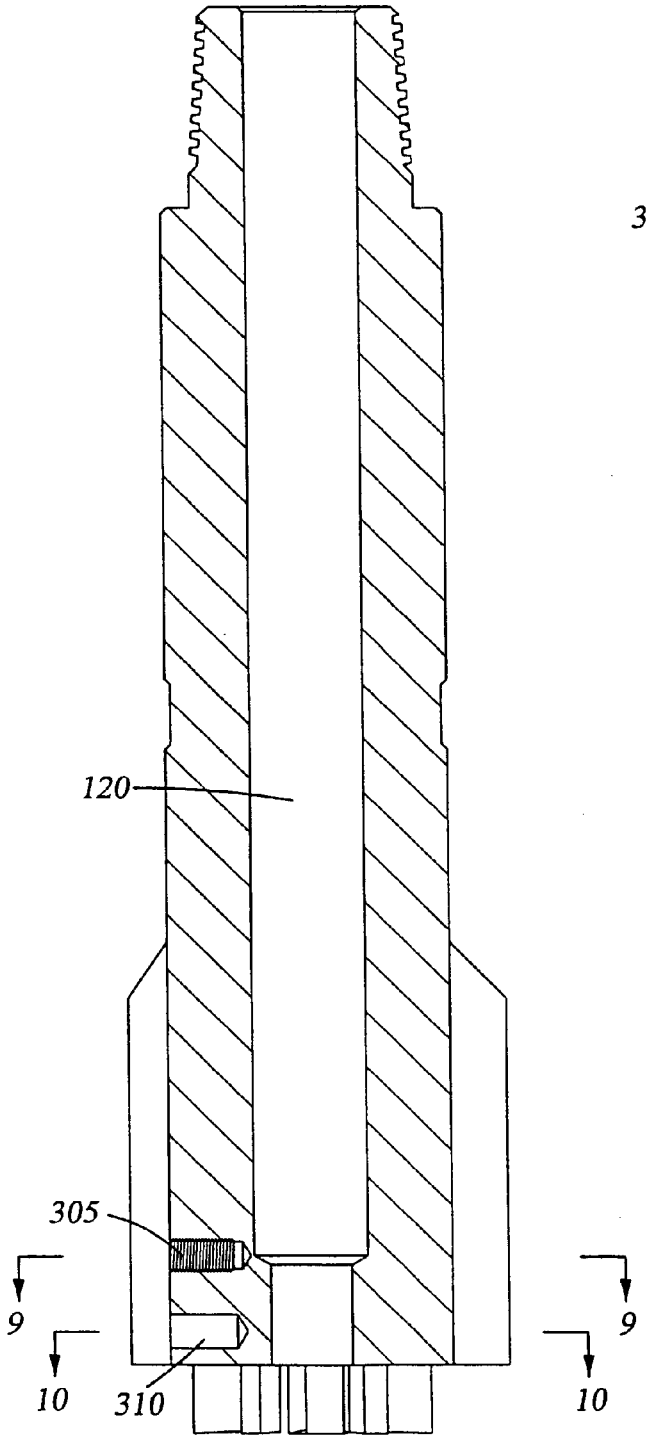
FIG. 8 is a front view, partially in section of the cutter illustrating the apertures formed therein.
Figure 9:
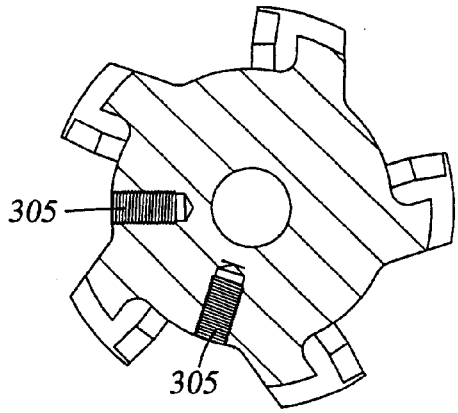
FIGS. 9–10 are section views taken along lines 9–9 and 10–10 of FIG. 8.
Figure 10:
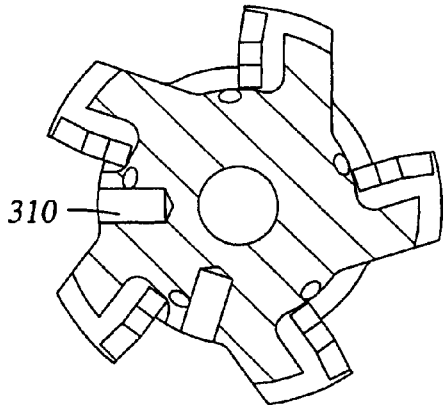

FIGS. 8–10 illustrate the apertures formed in the cutter that cooperate with the apertures formed in the lugs of the whipstock to make up the shearable connection. Specifically, FIG. 8 shows the upper 305 and lower 310 receiving apertures formed in the cutter 120. In the preferred embodiment, the upper receiving aperture 305 is threaded to receive a threaded fastener and the lower receiving aperture 310 is non-threaded for receipt of a pin member therein. In the embodiment shown, the pin members are held in place by frictional forces between the pin and the aperture. However, the pins could be retained in the apertures by a latching mechanism wherein the pins lock into place through rotation.

Figure 11:
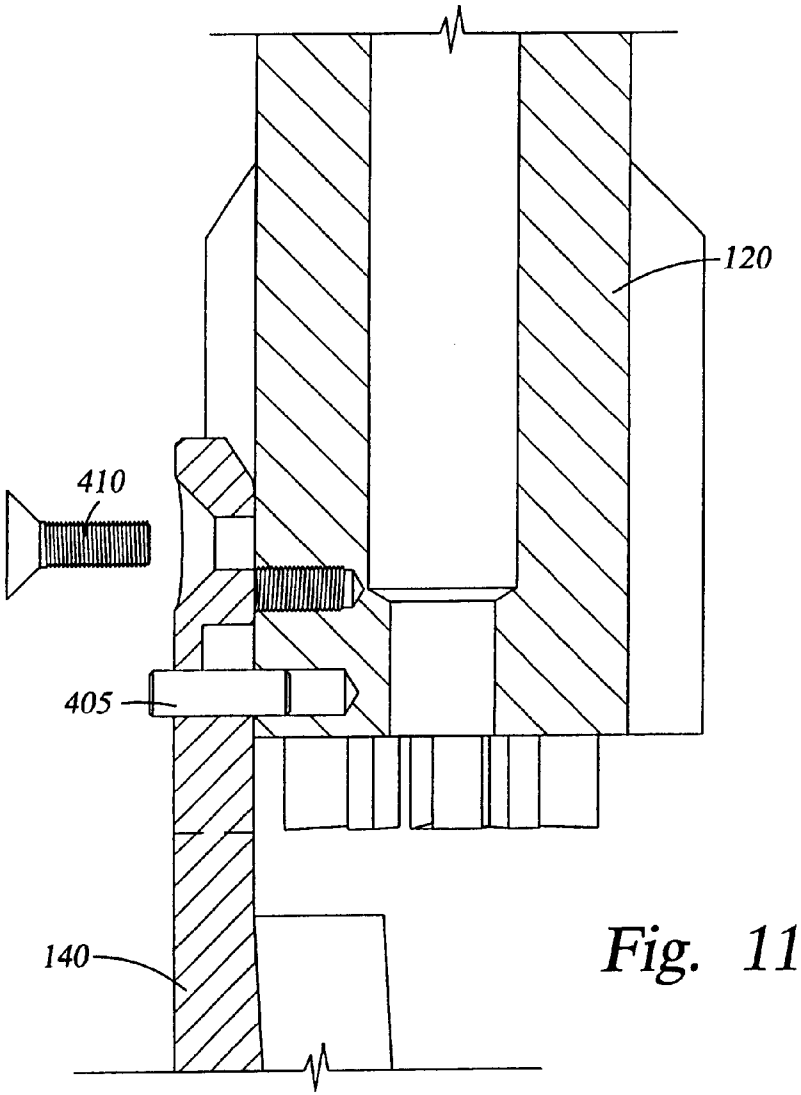
FIG. 11 is a section view showing the shearable connection during assembly.

FIGS. 11–14 are section views depicting the shearable connection between the cutter 120 and the lugs 140 of the whipstock and the shearing of the connection member in the well. Specifically, FIG. 11 depicts the manner in which the connection is assembled with a pin 405 inserted through elongated aperture 210 of lug 140 and into lower receiving aperture 310 of cutter 120.

Figure 12:
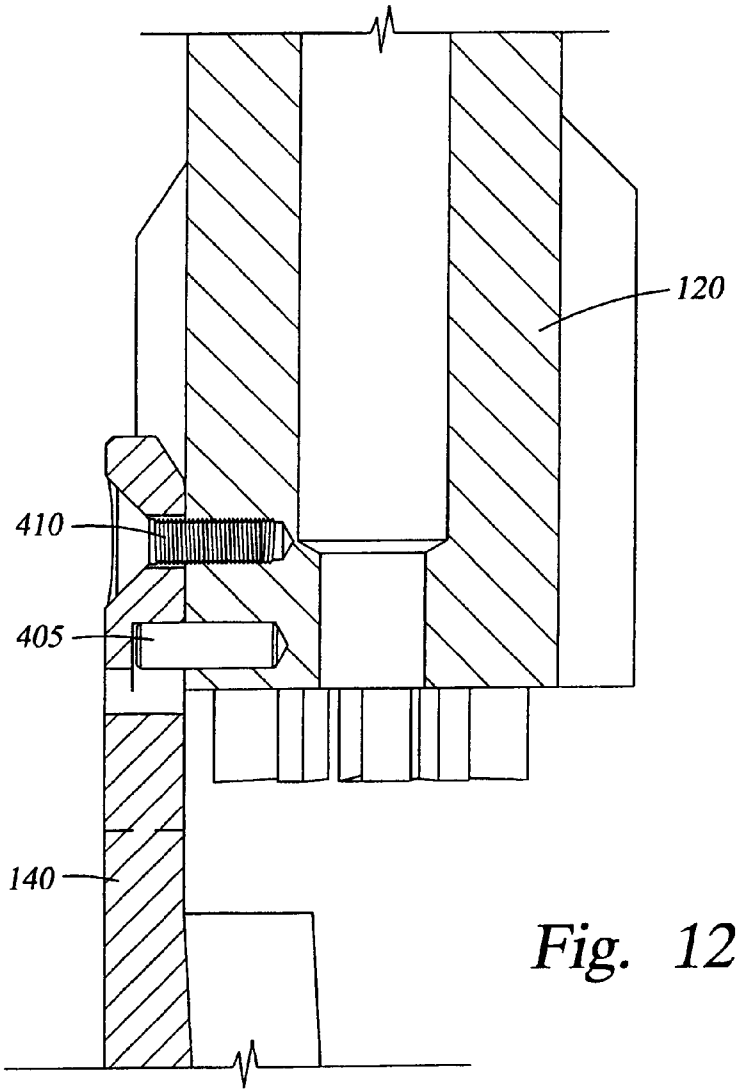
FIG. 12 is a section view showing the shearable connection prior to shearing.

FIG. 12 illustrates a threaded member 410 inserted through the circular aperture 205 and the lug 140 and into the upper receiving aperture 305 in the cutter after the pin 405 has been inserted thereunder and is free to travel within the elongated aperture 210 formed in the lug 140. FIG. 12 illustrates the shearable connection between the whipstock lug 140 and the cutter 120 as it would appear in the well prior to shearing of the connection. Specifically, when a tension force is applied between the whipstock and cutter and the lug is pulled downwards in relation to the cutter, both the threaded member 410 and the pin 405 thereunder bear the shear load. In this manner, the strength of the connection is enhanced when the assembly is being lowered into the wellbore and a tensile force is being applied between the whipstock and cutter due to the weight of the whipstock and extensions.

Figure 13:
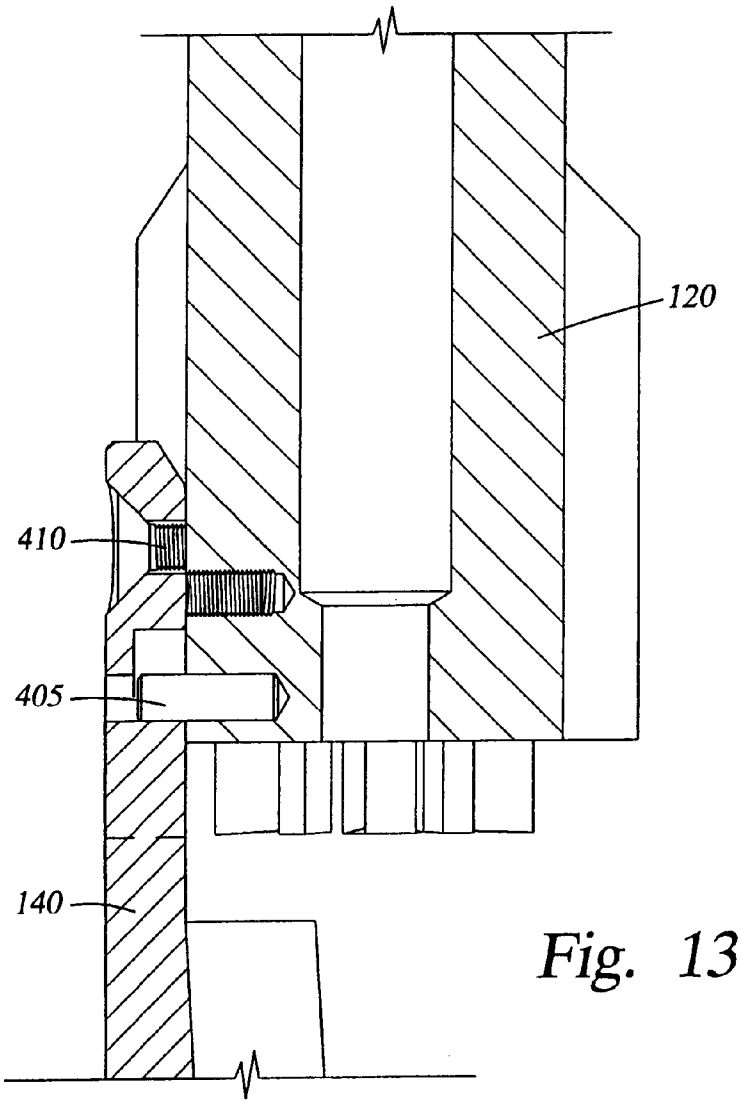
FIG. 13 is a section view showing the shearable connection as the threaded fastener fails.

FIG. 13 depicts the shearable connection just after a compressive force has been applied to the cutter 120 from above and sheared the threaded member. Specifically, the threaded member 410 has sheared and the cutter 120 has moved down in relation to the lugs 140 of the whipstock. Because the pin 405 is free to travel in the vertical space created by the slot shape, the pin 405 adds no resistive force to the compression force applied between the whipstock and cutter.

Figure 14:
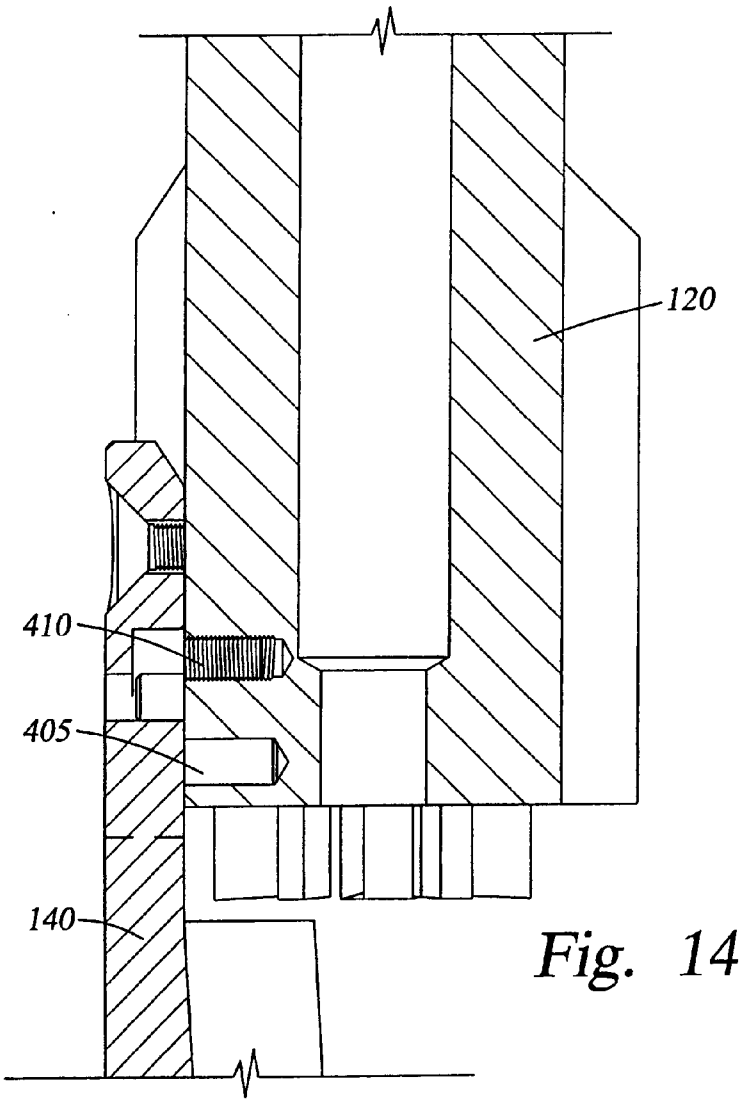
FIG. 14 is a section view showing the shearable connection as the pin fails.

FIG. 14 depicts the shearable connection after the pin 405 has moved vertically in the slot-shaped aperture and is then sheared by the force of the cutter 120 moving downward in relation to the lug 140. In this manner, the compressive force necessarily applied between the whipstock and cutter is limited to that force needed to shear only the threaded member 410. Thereafter, the force needed to shear the pin member is largely supplied by the kinetic energy of the moving cutter 120. In this manner, the shearable connection strength is not enhanced against a compressive force applied between the whipstock and cutter, but only against a tensile force applied therebetween.

Figure 16:
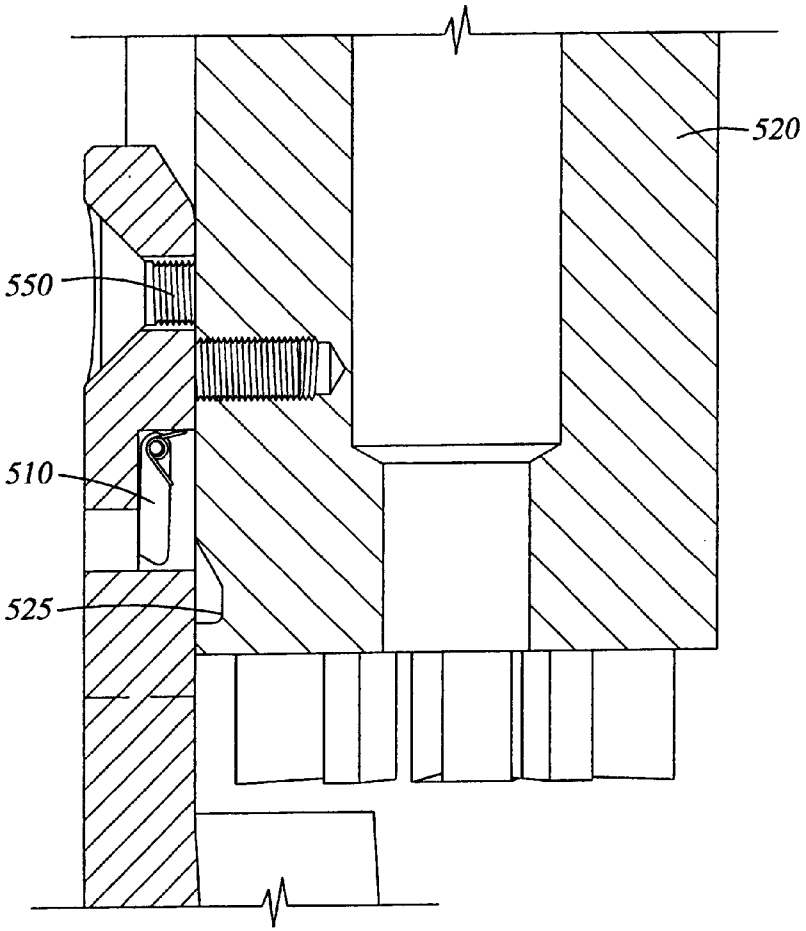
FIG. 16 is a section view of the second embodiment after the shearable connection has failed.
Figure 15:
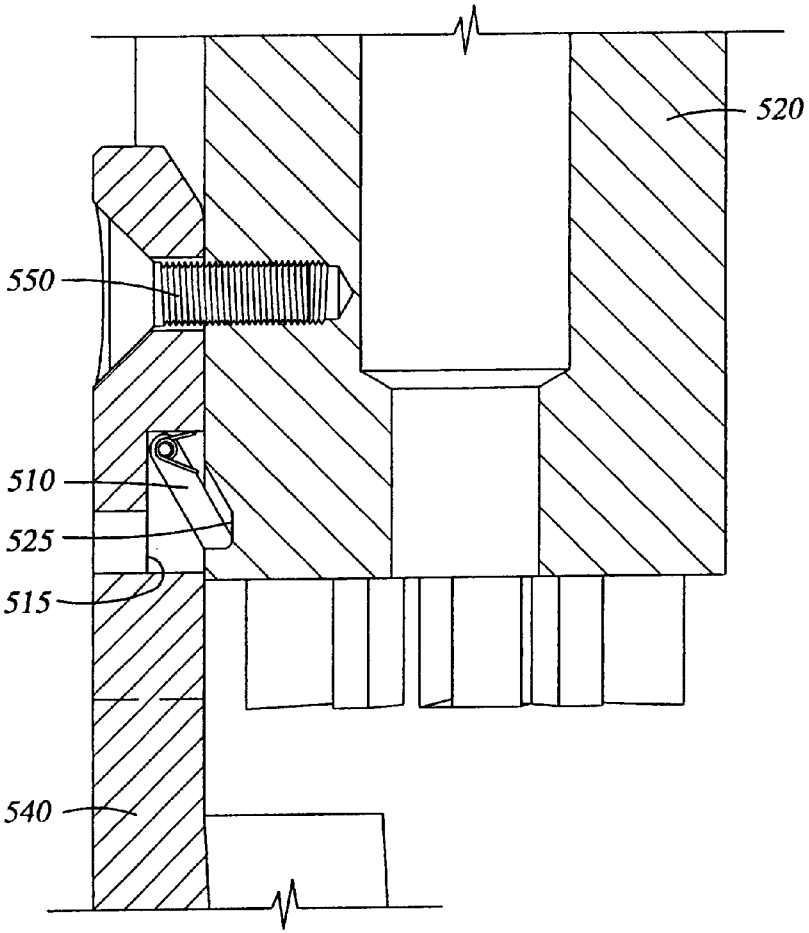
FIG. 15 is a section view of an alternative embodiment of the shearable connection prior to shearing.

FIGS. 15 and 16 show an alternative embodiment of the present invention wherein a spring-biased finger 510 adds strength to the shearable connection against a tensile force but not against a compressive force. FIG. 16 depicts the relationship between the cutter 520, the whipstock lug 540 and the spring-biased finger 510 prior to failure of the shearable connection. Specifically, a slot 515 is formed on the inside surface of the lug 540 of the whipstock and the spring-biased finger 510 is mounted therein. The finger 510 is biased away from the cutter 520 and prior to failure of the shearable connection, the finger 540 is held within a cutout 525 formed in the outer surface of the cutter 520. As the whipstock assembly is lowered into the well and tensile forces are acting upon the shearable member, the finger 525 serves to enhance the strength of the shearable connection against tensile forces applied between the whipstock and cutter.

FIG. 16 depicts the shearable connection of the embodiment just after failure due to a compressive force applied between the whipstock and cutter. A compressive force has been applied and a threaded member 550 has sheared. Rather than resist the compressive forces, the spring-loaded member 510 has retreated into slot 515 where it no longer interferes with movement between the cutter and whipstock.

Figure 17:
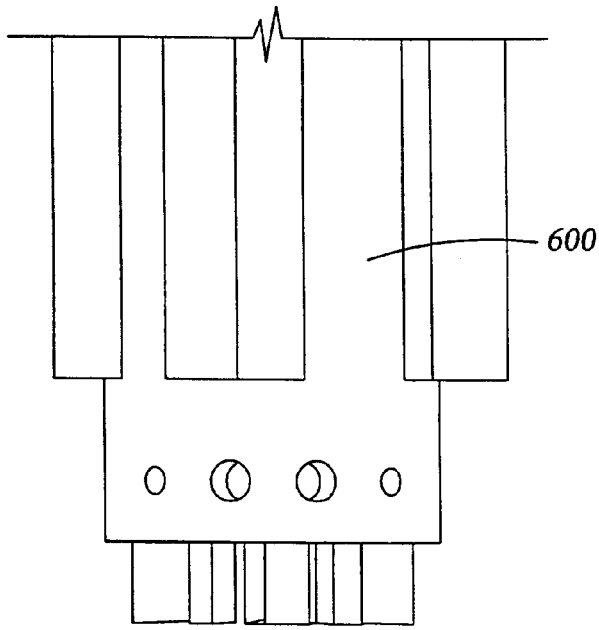
FIG. 17 is a front view of an alternative embodiment of the invention depicting apertures formed in the cutter having a horizontal orientation.
Figure 18:
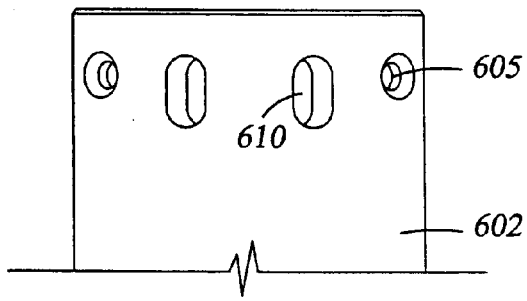
FIG. 18 is a front view of the outside of the lug portion of the whipstock depicting two elongated apertures and two circular apertures formed therethrough.
Figure 19:
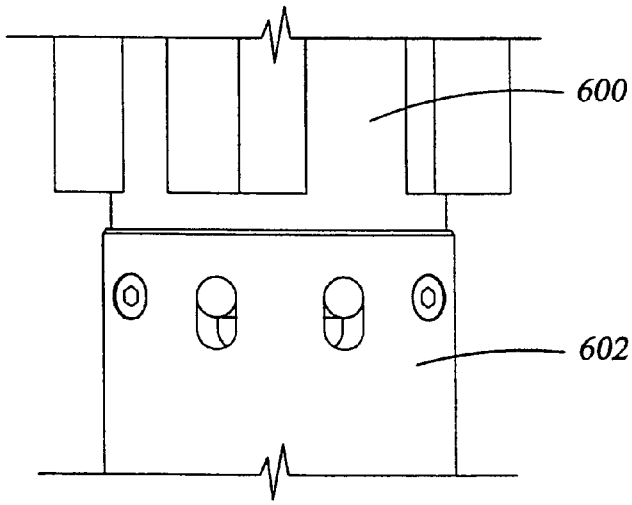
FIG. 19 is a front view of the shearable connection between the lug portion of the whipstock and the cutter.

FIG. 17 is a front view of a cutter 600 showing an alternative arrangement of the shearable connection wherein the apertures are arranged in a horizontal fashion. FIG. 18 is a front view of the outside surface of the lug portion 602 of the whipstock depicting the horizontal arrangement of the apertures including circular apertures 605 and elongated apertures 610. In operation, the shearable connection provides additional shear strength to tensile forces between the whipstock and cutter but not to compressive forces applied therebetween. FIG. 19 is a front view of the assembled shearable connection between the cutter 600 and the lug portion 602 of the whipstock.

Figure 20:
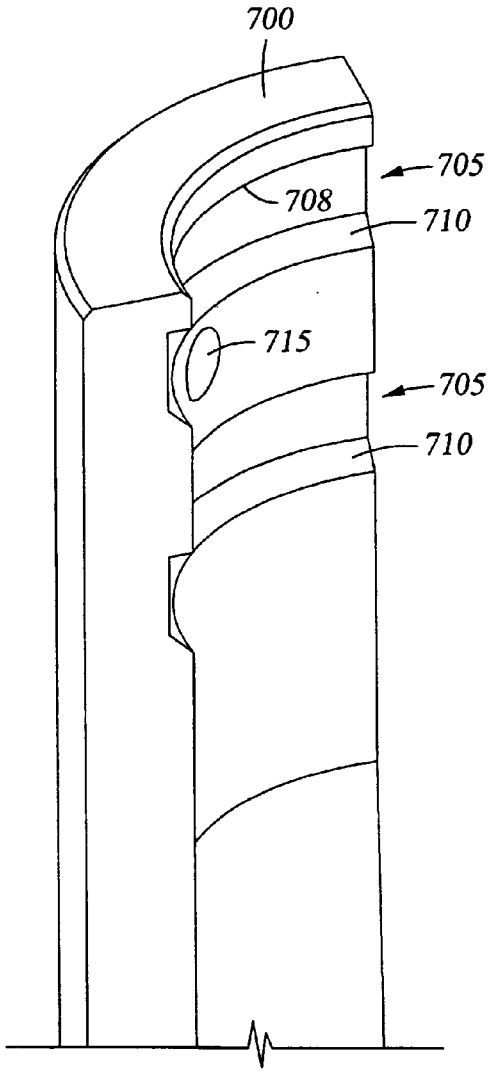
FIG. 20 is a perspective view of an alternative embodiment of the invention depicting two horizontal slots formed on the inner surface of the lug portion of the whipstock.
Figure 21:
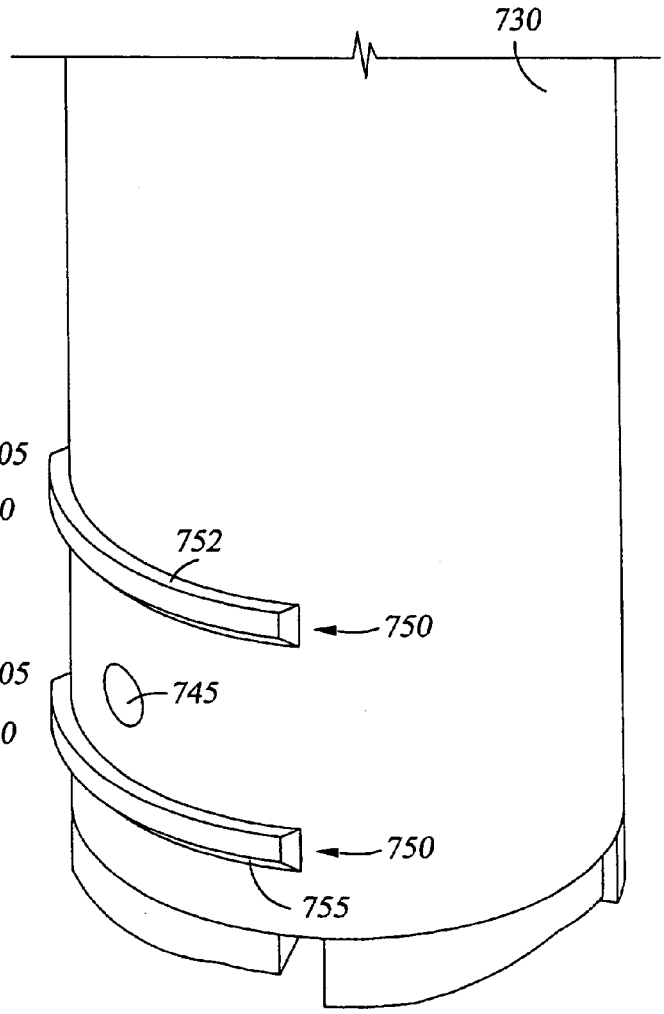
FIG. 21 is a perspective view showing horizontal ridges formed in the outer surface of the cutter.

FIG. 20 is a perspective view showing another embodiment of the invention wherein the inside surface of the lug portion 700 of the whipstock includes two horizontal grooves 705 formed therein. The grooves 705 extend the entire distance around the inside surface of the lug portion 700 and each groove includes a bottom, upper and lower surface. In the preferred embodiment, the upper surface 708 of each groove is perpendicular to the bottom surface thereof and is designed to interfere with a mating upper surface 752 of a ridge 750 formed on the outer surface of a cutter 730. The lower surface 710 of the groove 705 is sloped downward and is likewise designed to interact with a mating surface 755 formed on the ridge 750 of the cutter 730. A single aperture 715 extends through the lug portion 700 and aligns with a threaded aperture 745 formed in the cutter 730. FIG. 21 is a perspective view of the cutter 730 showing the two ridges 750 formed thereon. The ridges are constructed and arranged to interact with the grooves 705 formed in the lug portion 700 and to create a connection therewith that provides shearable resistance to one force applied between the whipstock and cutter but not to an opposite force. Specifically, the grooves have an upper surface 752 that is perpendicular to the surface of the cutter and is designed to interfere with the upper surface 708 of groove 705. The lower surface 755 of each ridge 750 is sloped to mate with the lower surface 710 of the groove 705 and minimize interference therebetween.

Figure 22:
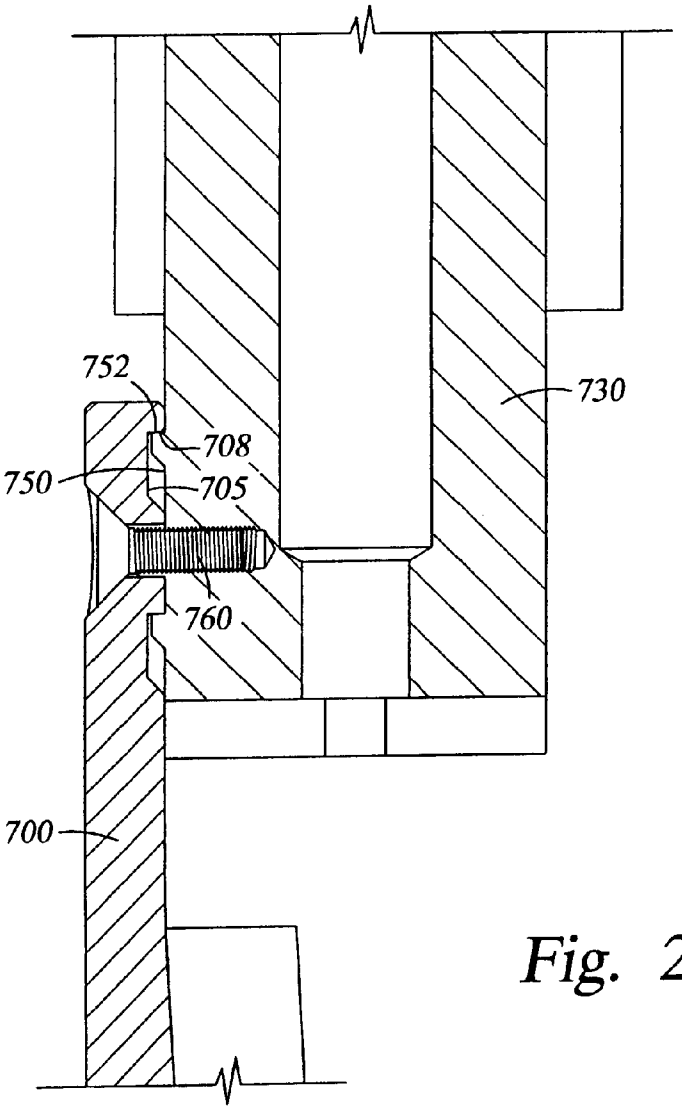
FIG. 22 is a section view showing the inner action between the horizontal grooves formed in the lug portion and the horizontal ridges formed in the outer portion of the cutter.

FIG. 22 depicts the shearable connection of the embodiment as it appears prior to the failure of the shearable connection. A single threaded fastener 760 extends between the lug portion 700 and the cutter 730 providing shear resistance to both compressive and tensile forces applied between the whipstock and cutter 730. The ridges 750 formed on the outer surface of the cutter 730 are housed within the groove 705 formed on the inner surface of the lug portion 700 and the interaction of the mating perpendicular surfaces 708, 752 acts to add shear strength to tensile forces applied between the whipstock and cutter 730. As the whipstock assembly is lowered into a wellbore and prior to the landing of the whipstock or extension into a packer or other anchor, tensile forces present between the whipstock and cutter are born by the groove 705 and ridge 750 members as well as the threaded member 760.

Figure 23:
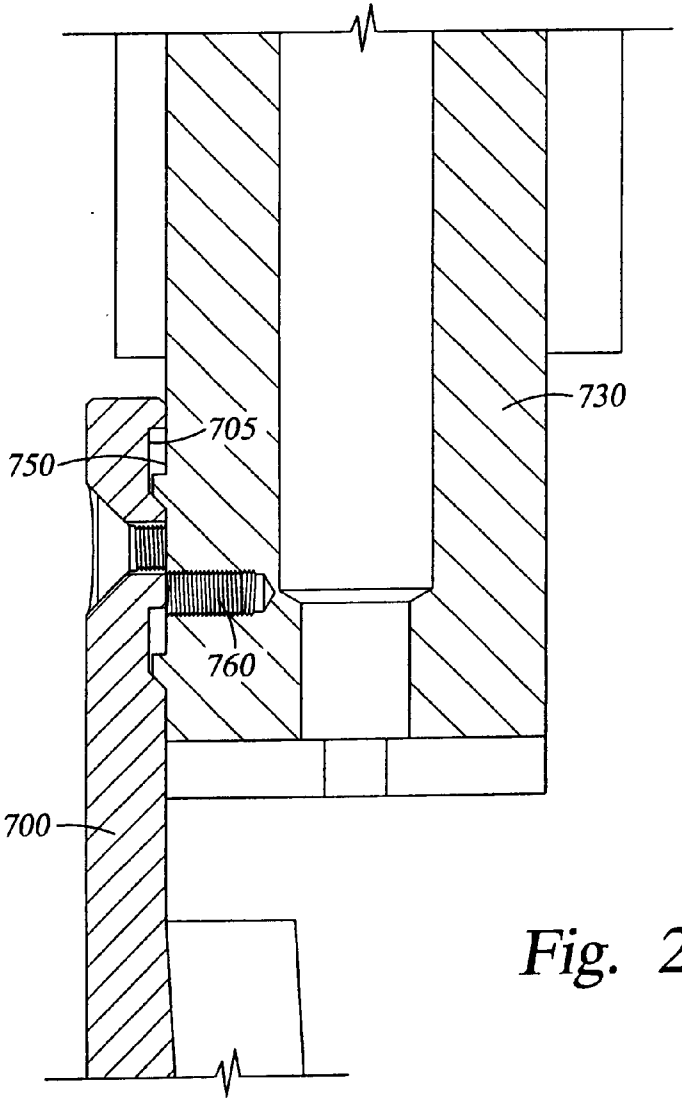
FIG. 23 is a section view showing the shearable connection upon failure of the threaded member.

FIG. 23 depicts the shearable connection of the embodiment as the connection fails due to a compressive force between the whipstock and cutter. The threaded member 760 has failed and the cutter 730 has moved down in relation to the lug portion 700. The mating surfaces of the grooves 705 and the ridges 750 have moved across each other allowing the movement of the cutter 730 in relation to the lug portion. After failure, the cutter is rotated out of alignment with the grooves of the lug portion 700, allowing the cutter to be raised above the whipstock prior to the commencement of the cutting action.

Figure 24:
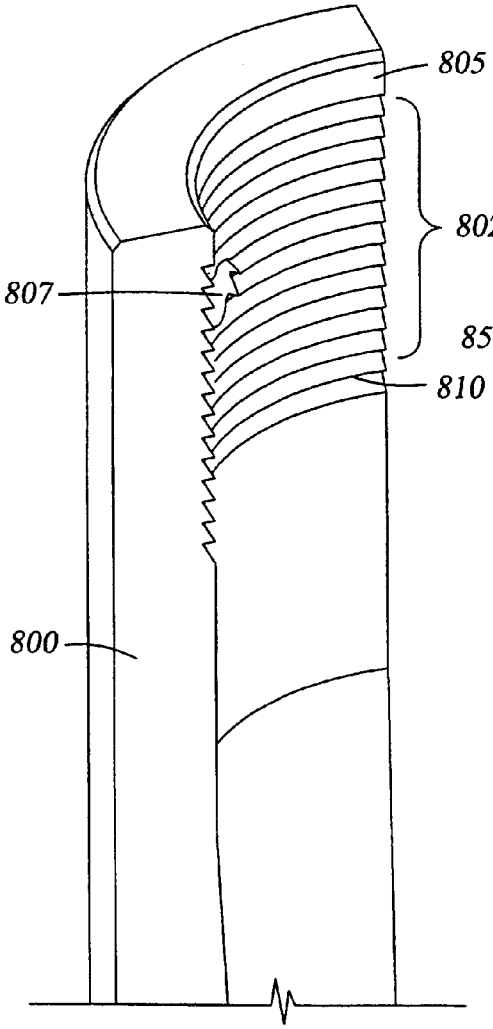
FIG. 24 is a perspective view of an alternative embodiment of the invention showing a plurality of ridges formed on the inside surface of the lug portion of the whipstock.
Figure 25:
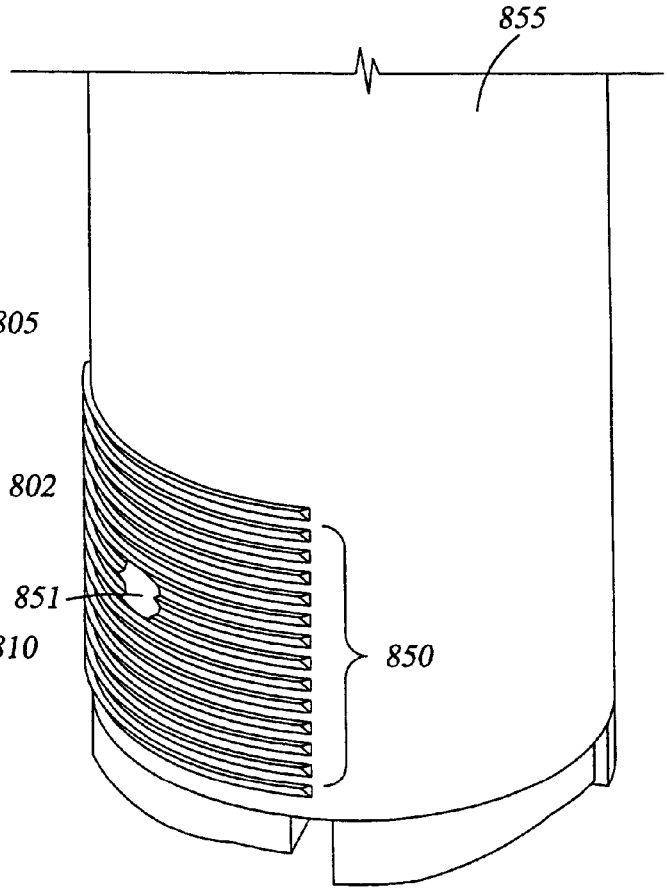
FIG. 25 is a perspective view showing a plurality of ridges formed on the outer surface of the cutter.

FIG. 24 is a perspective view of another embodiment of the invention showing a plurality of profiles 802 formed in the inside surface of a lug portion 800 of a whipstock. The profiles are horizontal in orientation and extend the entire distance across the inside surface of the lug. Each profile includes an upper surface 810 and a lower surface 805. In the preferred embodiment, the upper surface 810 of each profile is substantially perpendicular to the surface of the lug portion and the lower surface 805 of each profile is sloped downward. An aperture 807 (not shown) is formed through the lug portion. FIG. 25 is a perspective view of an outer surface of a cutter 855 depicting a plurality of profiles 850 formed thereupon. A threaded aperture 851 is formed in the cutter surface. In the preferred embodiment, each profile formed on the cuter is constructed and arranged to interact with the profiles 802 formed on the lug portion 800 such that the profiles fit together to add shear resistance to a first force between the whipstock and cutter but not to an opposite force therebetween.

Figure 27:
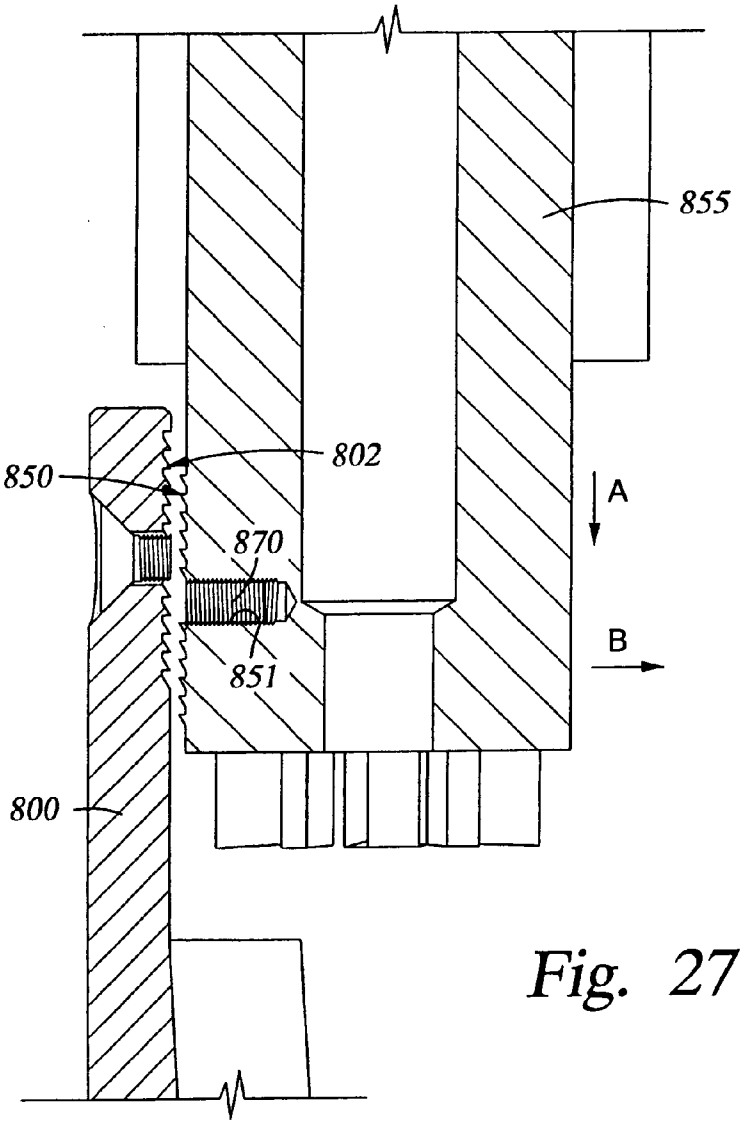
FIG. 27 is a section view showing the shearable connection just after the threaded member has failed.
Figure 26:
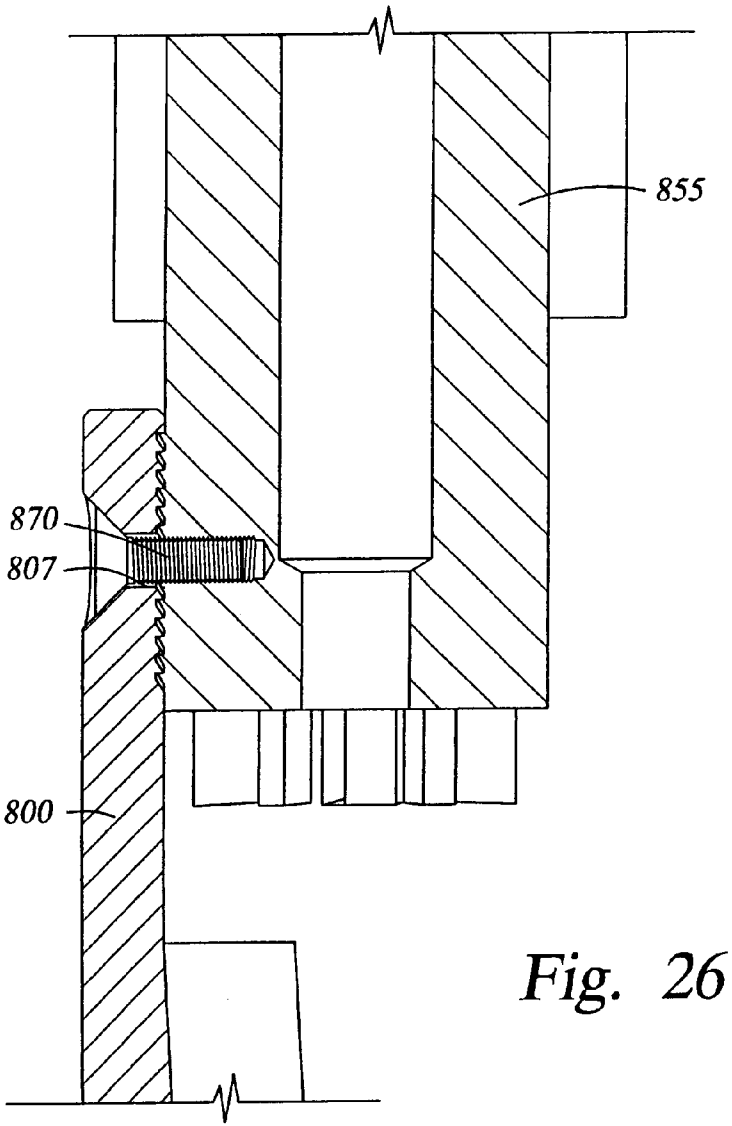
FIG. 26 is a section view depicting the inner action between the ridges formed on the inside surface of the lug portion and the outside surface of the cutter.

FIG. 26 is a section view showing the shearable connection of the embodiment prior to failure. A threaded fastener 870 extends through aligned apertures 807, 851 in the lug portion 800 and cutter 855. The profiles 802 formed upon the inner surface of the lug portion 800 engage the profiles 850 formed upon the outer surface of the cutter 855 to create shear resistance to tensile forces applied between the whipstock and cutter as the assembly is lowered into a wellbore. The single threaded fastener 870 provides shear resistance in both directions. FIG. 27 is a section view of the embodiment showing the shearable connection just after failure. The threaded fastener 870 has failed and the cutter 855 has moved down in relation to the lug portion 800 of the whipstock. The matching profiles formed on the lug portion 800 and the cutter 855 have offered little additional resistance to the compressive force between the whipstock and cutter and the connection has failed due to force adequate only to shear the threaded fastener 870. The design of the shearable connection in this embodiment requires both a shearing and compressive force between the cutter and the whipstock as depicted by arrows A & B in FIG. 27.

The novel design of the shearable connections described herein add additional shear strength to a connection between a cutter and a whipstock assembly in response to a force applied between the whipstock and cutter thereby avoiding unintentional failure of the connection member due to increased weight of the whipstock assembly. At the same time, no additional shearing force is necessary in the opposite direction to separate the cutter from the whipstock in order to begin formation of a lateral wellbore.

While foregoing is directed to the preferred embodiment of the present invention, other and further embodiments of the invention may be devised without departing from the basic scope thereof, and the scope thereof is determined by the claims that follow.

What is claimed is:

1. A shearable connection between a whipstock and a cutter comprising:

at least one groove formed in an inside surface of the whipstock, the groove having an upper surface substantially perpendicular to the whipstock surface and a sloping lower surface;

at least one ridge formed on an outside surface of the cutter, the ridge having an upper surface substantially perpendicular to the cutter surface and a lower sloping surface, the ridge constructed and arranged to cooperate with the groove to provide shear resistance to a first force applied between the whipstock and the cutter but not to a second opposite force.

2. The shearable connection of claim 1, wherein upon application of the first force, the upper surface of the at least one groove interferes with the lower surface of the at least one ridge to provide a resistance.

3. The shearable connection of claim 2, wherein upon the application of the second force, the lower surface of the at least one groove does not substantially interfere with the upper surface of the at least one ridge and no substantial shear resistance is provided.

4. The shearable connection of claim 3, further including at least one shearable member between the whipstock and the cutter, the shearable member providing shear resistance to the first and second forces.

5. The shearable connection of 1, wherein an angle formed between the upper surface of the groove and the sloping lower surface of the groove is between 1 degree and 89 degrees.

6. The shearable connection of 1, wherein an angle formed between the upper surface of the ridge and the sloping lower surface of the ridge is between 1 degree and 89 degrees.

* * * * *